US009054420B2

(12) United States Patent
Chung et al.

(10) Patent No.: US 9,054,420 B2
(45) Date of Patent: Jun. 9, 2015

(54) ANTENNA MODULE

(71) Applicant: WISTRON CORP., New Taipei (TW)

(72) Inventors: Kuan-Jen Chung, New Taipei (TW); Wen-Yi Tsai, New Taipei (TW); Chia-Wei Su, New Taipei (TW)

(73) Assignee: Wistron Corp., New Taipei (TW)

( * ) Notice: Subject to any disclaimer, the term of this patent is extended or adjusted under 35 U.S.C. 154(b) by 195 days.

(21) Appl. No.: 13/714,271

(22) Filed: Dec. 13, 2012

(65) Prior Publication Data

US 2013/0335295 A1 Dec. 19, 2013

(30) Foreign Application Priority Data

Jun. 13, 2012 (TW) ..... 101121067 A

(51) Int. Cl.
*H01Q 1/50* (2006.01)
*H01Q 1/52* (2006.01)
*H01Q 21/28* (2006.01)

(52) U.S. Cl.
CPC ..... *H01Q 1/50* (2013.01); *H01Q 1/521* (2013.01); *H01Q 21/28* (2013.01); *H01Q 5/328* (2015.01)

(58) Field of Classification Search
CPC ..... H01Q 1/00; H01Q 1/24; H01Q 1/38
USPC ..... 343/904, 700 MS, 702, 804; 455/272
See application file for complete search history.

(56) References Cited

U.S. PATENT DOCUMENTS 6,614,400 B2 * 9/2003 Egorov ..... 343/702
6,831,607 B2 * 12/2004 Hebron et al. ..... 343/700 MS
7,180,465 B2 * 2/2007 Lynch et al. ..... 343/833
7,425,756 B2 * 9/2008 Danno et al. ..... 257/672
7,940,219 B2 * 5/2011 Soekawa et al. ..... 343/702
8,179,322 B2 * 5/2012 Nissinen ..... 343/700 MS
8,472,908 B2 * 6/2013 Anguera et al. ..... 455/272
2005/0168384 A1 8/2005 Wang et al.
2008/0106478 A1 * 5/2008 Hill ..... 343/702
2009/0156151 A1 6/2009 Anguera et al.
2012/0056692 A1 3/2012 Moon et al.

FOREIGN PATENT DOCUMENTS

CN 1384686 A 12/2002
CN 101273492 A 9/2008
CN 101662069 A 3/2010

OTHER PUBLICATIONS

China Patent Office, Office Action, Patent Application Serial No. 201210201445.7, Jan. 6, 2015, China.
Taiwan Patent Office, Office Action, Patent Application Serial No. 101121067, Jan. 30, 2015, Taiwan.

* cited by examiner

*Primary Examiner* — Huedung Mancuso

(57) ABSTRACT

An antenna module is provided. The antenna module includes a first ground element, a body, a radiator and a parasitic element. The body is electrically connected to the first ground element. The radiator is connected to the body, wherein the radiator includes an extending portion, a bending portion and a terminal portion, and the bending portion is connected to the extending portion, and the terminal portion is connected to the bending portion. The parasitic element includes a parasitic extending portion and a parasitic conductive portion, wherein the parasitic extending portion is connected to the parasitic conductive portion, and the terminal portion and the parasitic extending portion is located on a same straight line, and the terminal portion is separated from the parasitic extending portion.

18 Claims, 6 Drawing Sheets

ANTENNA MODULE

CROSS REFERENCE TO RELATED APPLICATIONS

This Application claims priority of Taiwan Patent Application No. 101121067, filed on Jun. 13, 2012, the entirety of which is incorporated by reference herein.

BACKGROUND OF THE INVENTION

1. Field of the Invention

The present invention relates to an antenna module, and in particular relates to an antenna module utilized in wideband transmissions.

2. Description of the Related Art

Nowadays, antenna modules of a single mobile device are being required to transmit wireless signals of frequency bands such as Long Term Evolution (LTE), and GSM850/900/1800/1900/UMTS (Penta band) to provide convenience and faster transmission speeds to user.

However, to satisfy the LTE and Penta band standers simultaneously, the dimensions of the antenna module need to be increased. Otherwise, the transmission effect of the antenna module would deteriorate. Particularly, the transmission effect of a lower band portion of the antenna module would deteriorate with decreased antenna dimensions.

BRIEF SUMMARY OF THE INVENTION

An antenna module is provided. The antenna module includes a first ground element, a body, a radiator and a parasitic element. The body is electrically connected to the first ground element. The radiator is connected to the body, wherein the radiator includes an extending portion, a bending portion and a terminal portion, and the bending portion is connected to the extending portion, and the terminal portion is connected to the bending portion. The parasitic element includes a parasitic extending portion and a parasitic conductive portion, wherein the parasitic extending portion is connected to the parasitic conductive portion, the terminal portion and the parasitic extending portion is located on a same straight line, and the terminal portion is separated from the parasitic extending portion.

The antenna module of the embodiment of the invention can be switched between the first and second transmission modes to transmit signals conforming to the LTE and Penta band standards with decreased dimensions.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
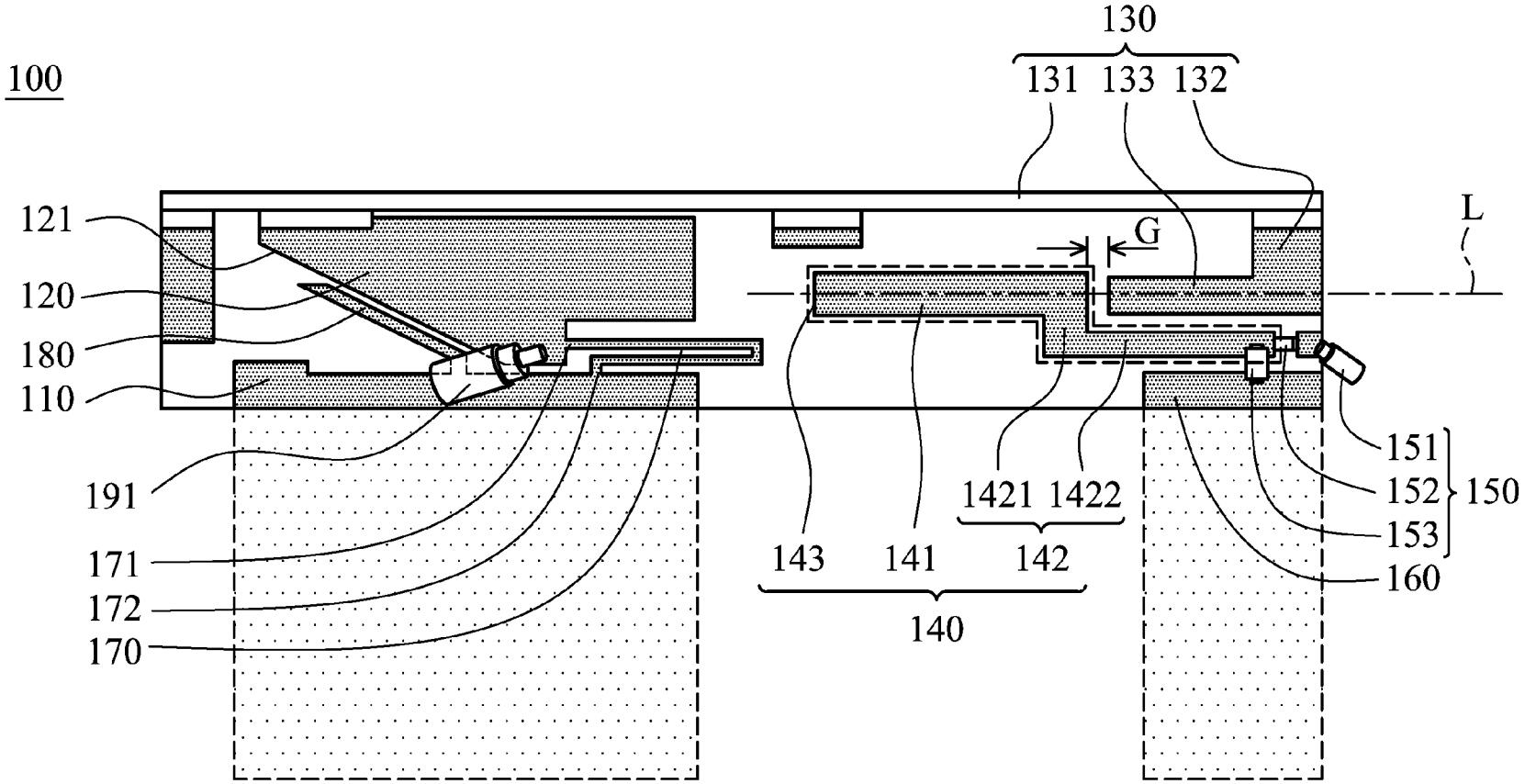
FIG. 1 shows the antenna module of the embodiment of the invention.

FIG. 1 shows an antenna module 100 of an embodiment of the invention, comprising a first ground element 110, a body 120, a radiator 130 and a parasitic element 140. The body 120 is electrically connected to the first ground element 110. The radiator 130 is connected to the body 120. The radiator 130 comprises an extending portion 131, a bending portion 132 and a terminal portion 133. The two ends of the bending portion 132 are respectively connected to the extending portion 131 and the terminal portion 133. The extending portion 131 is parallel to the terminal portion 133, and the extending direction of the extending portion 131 is opposite to the extending direction of the terminal portion 133. The parasitic element 140 comprises a parasitic extending portion 141 and a parasitic conductive portion 142, and the parasitic extending portion 141 is connected to the parasitic conductive portion 142. The terminal portion 133 and the parasitic extending portion 141 are located on a same straight line L.

With reference to FIG. 1, the antenna module 100 of the embodiment of the invention is shown to further comprise a switch unit 150 and a second ground element 160. The switch unit 150 is connected to the parasitic conductive portion 142. When the antenna module 100 is in a first transmission mode, the switch unit 150 electrically connects the parasitic conductive portion 142 to the second ground element 160. When the antenna module 100 is in a second transmission mode, the switch unit 150 electrically separates the parasitic conductive portion 142 from the second ground element 160.

With reference to FIG. 1, the switch unit 150 is shown to comprise a PIN (P-intrinsic-N) diode 153, wherein under the first transmission mode, an active voltage $V_f$ is applied to the PIN diode 153, and the PIN diode 153 connects the parasitic conductive portion 142 to the second ground element 160 according to the active voltage $V_f$.

Figure 2A:
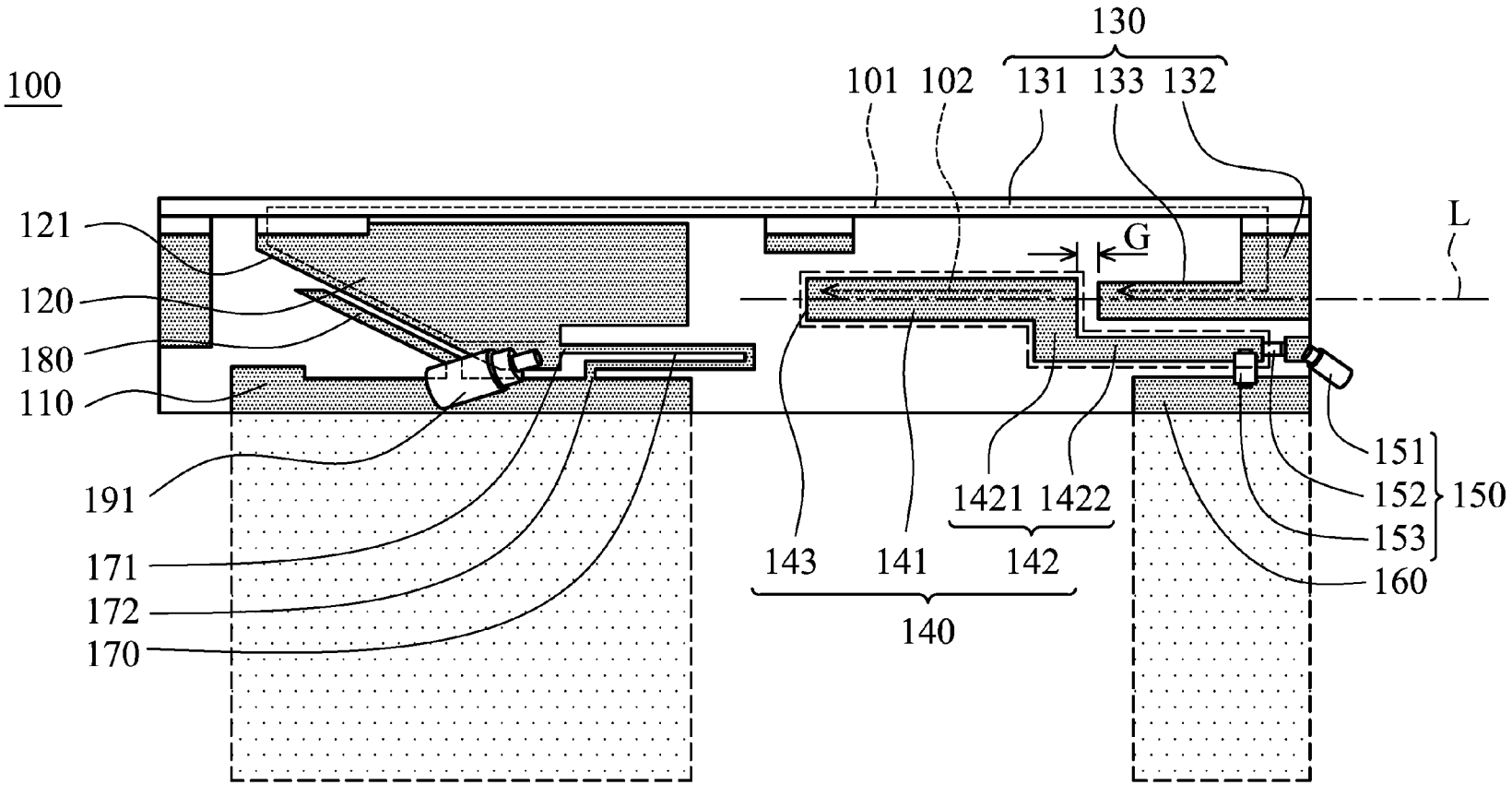
FIG. 2A shows the surface current distribution of the antenna module of the embodiment of the invention under the first transmission mode.
Figure 2B:
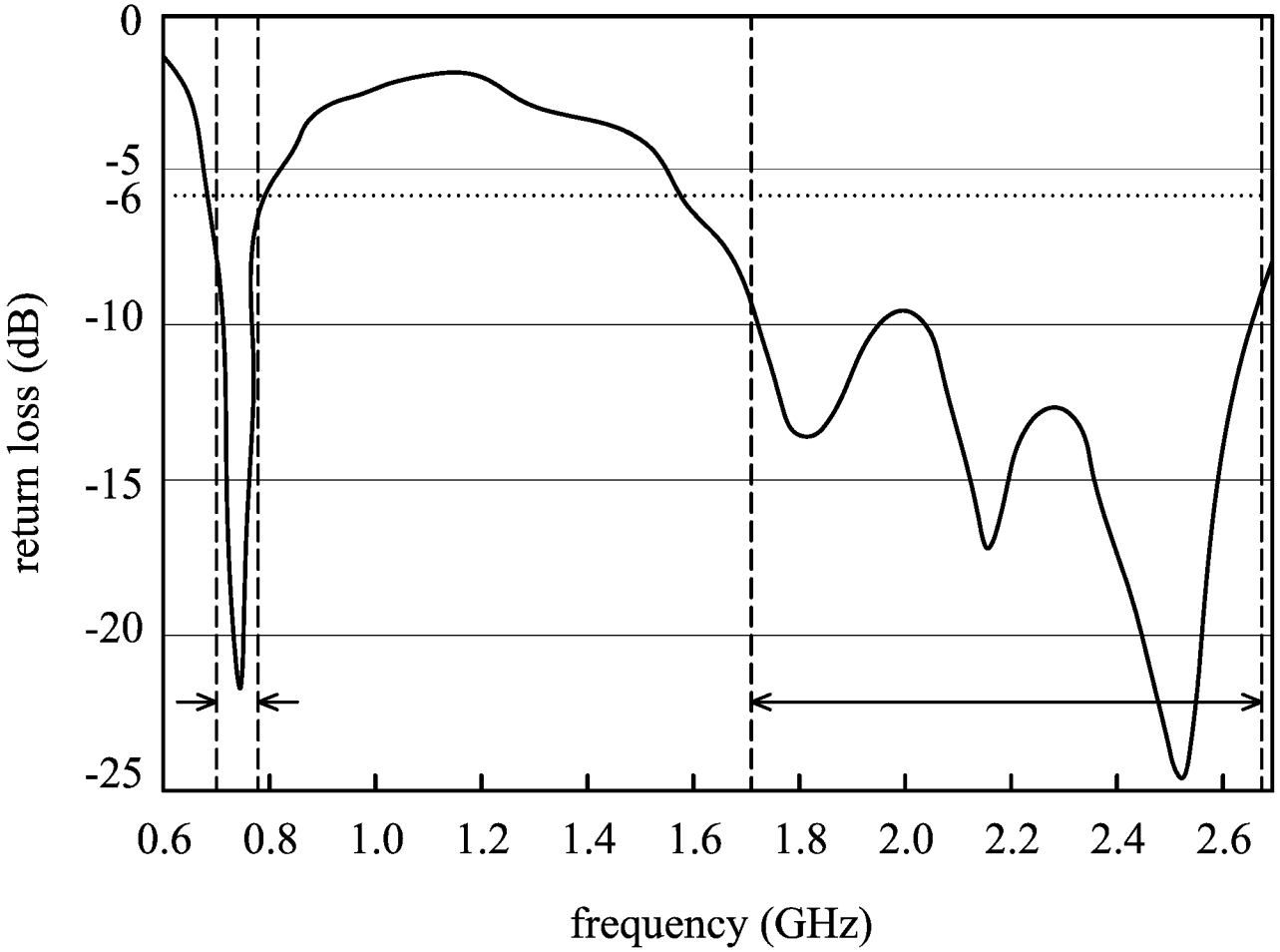
FIG. 2B shows the return loss of the antenna module of the embodiment of the invention under the first transmission mode.

With reference to FIG. 1, a feed line 191 is shown to feed a signal to the body 120. With reference to FIG. 2A, it is shown that when the antenna module 100 is under the first transmission mode, the terminal portion 133 couples to the parasitic extending portion 141, and a surface current 101 travels from the feed point, and passes through the body 120, the extending portion 131, and the bending portion 132, to the terminal portion 133. An equivalent current 102 is formed on the parasitic extending portion 141, and travels along the parasitic extending portion 141 to a free end 143 of the parasitic extending portion 141. Therefore, the effective current path of the radiator 130 is extended (in this embodiment, the effective current path is 85 mm), and the antenna module 100 can transmit signals which conform to the LTE standard (698-798 MHz). With reference to FIG. 2B, the return loss of the antenna module 100 under the first transmission mode is shown, wherein the effective lower band of the antenna module 100 is located in the range of 698-798 MHz.

Figure 3A:
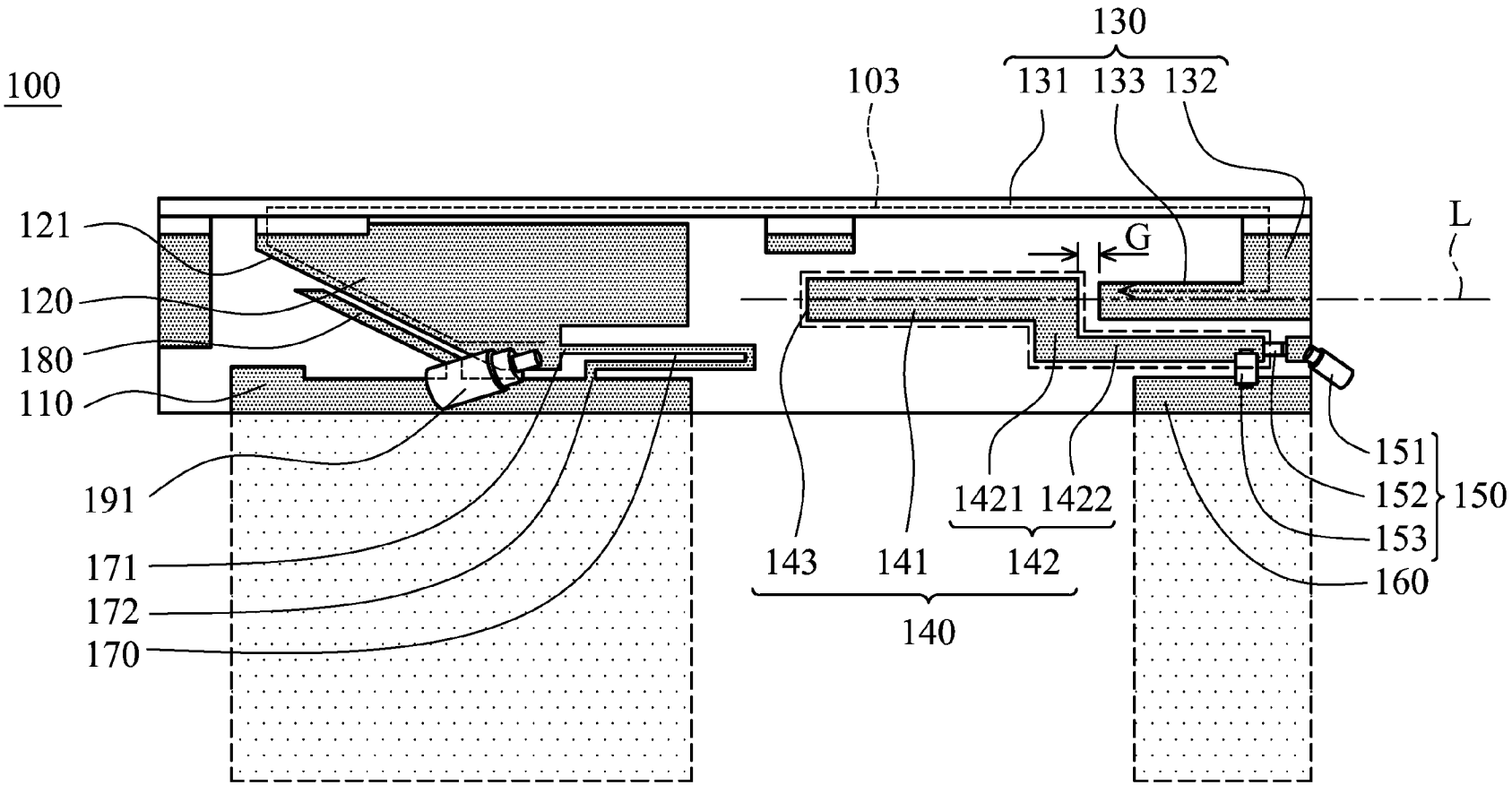
FIG. 3A shows the surface current distribution of the antenna module of the embodiment of the invention under the second transmission mode.
Figure 3B:
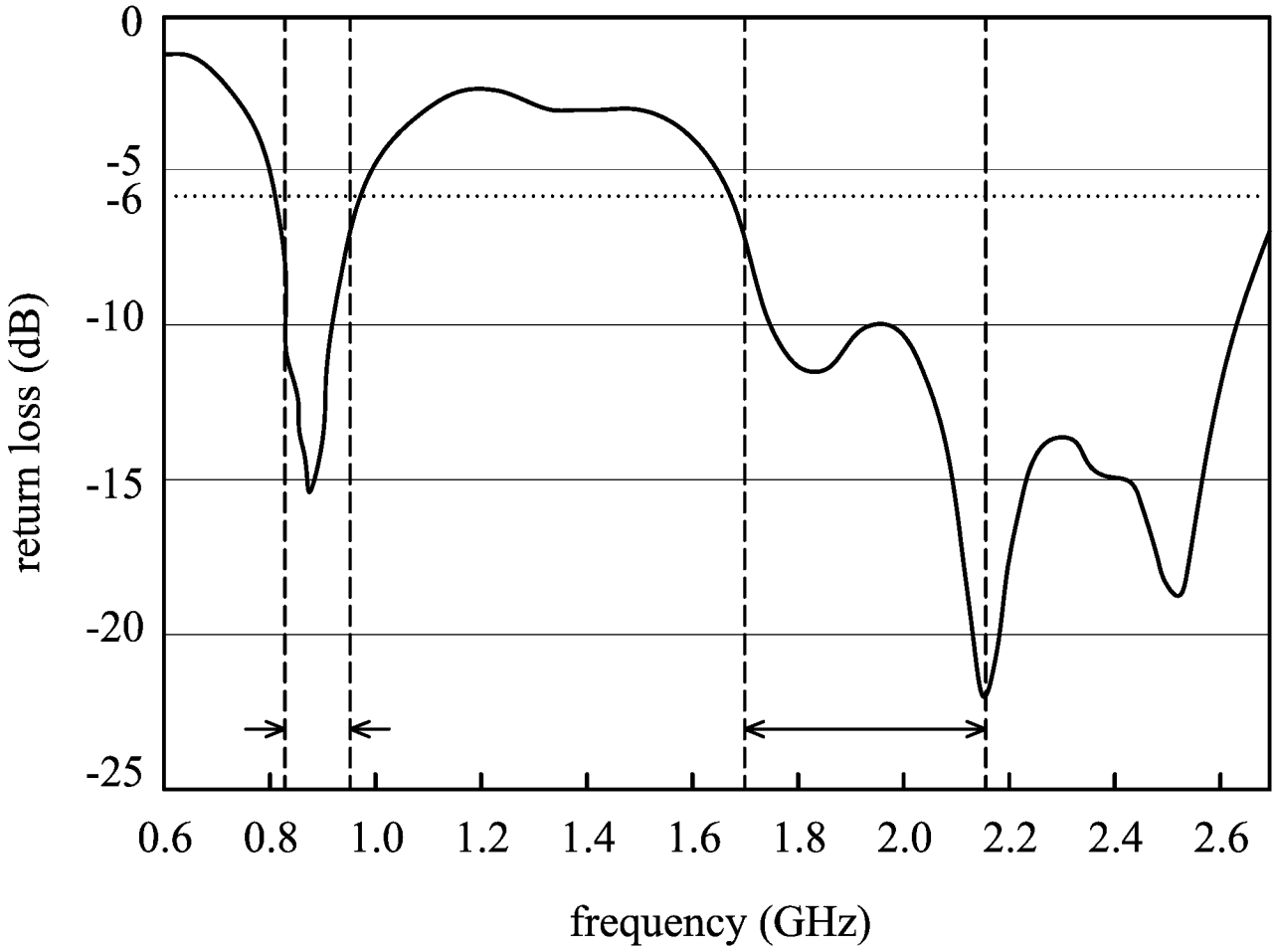
FIG. 3B shows the return loss of the antenna module of the embodiment of the invention under the second transmission mode.

With reference to FIG. 3A, when the antenna module 100 is under the second transmission mode, a surface current 103 is shown to travel from the feed point, and pass through the extending portion 131, and the bending portion 132 to the terminal portion 133. Under the second transmission mode, the effective current path of the radiator 130 is shorter (in this embodiment is 65 mm), and the transmission band of the antenna module 100 shifts. FIG. 3B shows the return loss of the antenna module 100 under the second transmission mode, wherein the transmission band of the antenna module 100 (particularly, lower band) is located in the band conforming to the Penta band standard.

In the previous embodiment, a gap G is formed between the terminal portion 133 and the parasitic extending portion 141. The gap G can be between 0.1 mm to 0.5 mm, for example, 0.3 mm.

The antenna module of the embodiment of the invention can have decreased dimensions and also be switched between the first and second transmission modes to transmit signals conforming to the LTE and Penta band standards. However, the disclosed types of standards do not limit the invention. The invention can be utilized to the switching of bands of other standards.

With reference to FIG. 1, in the embodiment of the invention, the first ground element 110 and the second ground element 160 are grounded. The first ground element 110 can be electrically connected to the second ground element 160, or integrally formed with the second ground element 160.

With reference to FIG. 1, in this embodiment, the parasitic element 140 is lightning-shaped. The parasitic extending portion 141 is longitudinal, and the parasitic conductive portion 142 is L-shaped. An end of the parasitic conductive portion 142 is connected to the parasitic extending portion 141, and the other end of the parasitic conductive portion 142 is connected to the switch unit 150.

With reference to FIG. 1, the parasitic conductive portion 142 comprises a first section 1421 and a second section 1422, the first section 1421 is connected to the second section 1422, the first section 1421 is connected to the parasitic extending portion 141, the second section 1422 extends parallel to the terminal portion 133, and a first extending direction of the first section 1421 is perpendicular to a second extending direction of the second section 1422. The second section 1422 extends parallel to? the terminal section 133. The second section 1422 is located between the terminal portion 133 and the second ground element 160.

With reference to FIG. 1, in this embodiment, the switch unit 150 further comprises a cable 151 and an inductor 152. The cable 151 provides the active voltage $V_f$. The inductor 152 is connected to the cable 151 and the parasitic element 140 for modifying the impedance matching of the radiator, the parasitic element and the PIN diode. In this embodiment, the inductance of the inductor 152 is greater than 12 nH, for example, 33 nH.

With reference to FIG. 1, in this embodiment, the antenna module 100 further comprises a short structure 170 and a parasitic radiator 180. The short structure 170 is U-shaped, and an end 171 of the short structure 170 is connected to the body, and the other end 172 of the short structure 170 is connected to the first ground element 110. The parasitic radiator 180 is connected to the first ground element 110, and the body 120 comprises a body edge 121, wherein the parasitic radiator 180 extends parallel to the body edge 121.

Figure 4:
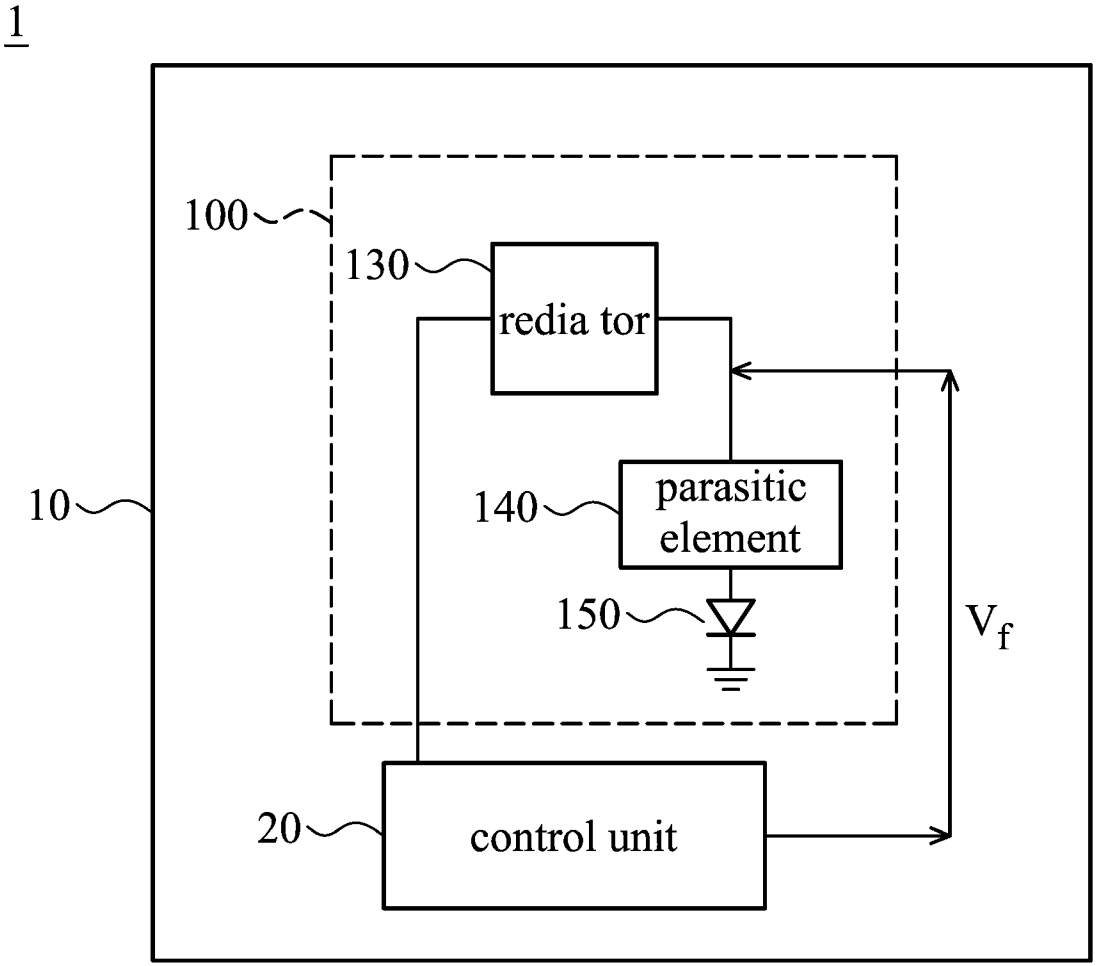
FIG. 4 is a block diagram of an electronic device utilizing the antenna module of the embodiment of the invention.

FIG. 4 is a block diagram of an electronic device 1 utilizing the antenna module 100 of the embodiment of the invention. The electronic device 1 comprises a housing 10 and a control unit 20. The control unit 20 is disposed in the housing 10. The antenna module 100 is electrically connected to the control unit 20. Under the first transmission mode, the control unit 20 applies the active voltage $V_f$ to the switch unit, and the switch unit 150 connects the parasitic element 140 to the ground according to the active voltage $V_f$.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna module, comprising:

a first ground element;

a body, electrically connected to the first ground element;

a radiator, connected to the body, wherein the radiator comprises an extending portion, a bending portion and a terminal portion, and the bending portion is connected to the extending portion, and the terminal portion is connected to the bending portion;

a parasitic element, comprising a parasitic extending portion and a parasitic conductive portion, wherein the parasitic extending portion is connected to the parasitic conductive portion, the terminal portion and the parasitic extending portion is located on a same straight line, and the terminal portion is separated from the parasitic extending portion;

a switch unit, connected to the parasitic conductive portion; and a second ground element, wherein when the antenna module is in a first transmission mode, the switch unit electrically connects the parasitic conductive portion to the second ground element, and when the antenna module is in a second transmission mode, the switch unit electrically separates the parasitic conductive portion from the second ground element.

2. The antenna module as claimed in claim 1, wherein when the antenna module is in the first transmission mode, the terminal portion is coupled to the parasitic extending portion, such that a surface current travels along the extending portion and the bending portion to the terminal portion, and an equivalent current travels along the parasitic extending portion to a free end of the parasitic extending portion.

3. The antenna module as claimed in claim 1, wherein the switch unit comprises a PIN diode, and in the first transmission mode, an active voltage is applied to the PIN diode, and the PIN diode connects the parasitic conductive portion to the second ground element according to the active voltage.

4. The antenna module as claimed in claim 1, wherein the first ground element is electrically connected to the second ground element.

5. The antenna module as claimed in claim 1, wherein the parasitic extending portion is longitudinal, the parasitic conductive portion is L-shaped, an end of the parasitic conductive portion is connected to the parasitic extending portion, and another end of the parasitic conductive portion is connected to the switch unit.

6. The antenna module as claimed in claim 5, wherein the parasitic conductive portion comprises a first section and a second section, and the first section is connected to the second section, and the first section is connected to the parasitic extending portion, wherein the second section extends parallel to the terminal portion, and a first extending direction of the first section is perpendicular to a second extending direction of the second section.

7. The antenna module as claimed in claim 6, wherein the second section extends parallel to the terminal section.

8. The antenna module as claimed in claim 6, wherein the second section is located between the terminal portion and the second ground element.

9. The antenna module as claimed in claim 1, further comprising a short structure, wherein the short structure is U-shaped, and an end of the short structure is connected to the body, and another end of the short structure is connected to the first ground element.

10. The antenna module as claimed in claim 1, further comprising a parasitic radiator, wherein the parasitic radiator is connected to the first ground element, and the body comprises a body edge, and the parasitic radiator extends parallel to the body edge.

11. An electronic device, comprising:

a housing;

a control unit, disposed in the housing; and an antenna module, electrically connected to the control unit, comprising:

a first ground element;

a body, electrically connected to the first ground element;

a feed line, electrically connected to the body;

a radiator, connected to the body, wherein the radiator comprises an extending portion, a bending portion and a terminal portion, and the bending portion is connected to the extending portion, and the terminal portion is connected to the bending portion;

a parasitic element, comprising a parasitic extending portion and a parasitic conductive portion, wherein the parasitic extending portion is connected to the parasitic conductive portion, and the terminal portion and the parasitic extending portion is located on a same straight line;

a switch unit, connected to the parasitic conductive portion; and a second ground element, wherein when the antenna module is in a first transmission mode, the switch unit electrically connects the parasitic conductive portion to the second ground element, and when the antenna module is in a second transmission mode, the switch unit electrically separates the parasitic conductive portion from the second ground element.

12. The electronic device as claimed in claim 11, wherein when the antenna module is in the first transmission mode, the terminal portion is coupled to the parasitic extending portion, such that a surface current travels along the extending portion and the bending portion to the terminal portion, and an equivalent current travels along the parasitic extending portion to a free end of the parasitic extending portion.

13. The electronic device as claimed in claim 11, wherein the switch unit comprises a PIN diode, and in the first transmission mode, the control unit applies an active voltage to the PIN diode, and the PIN diode connects the parasitic conductive portion to the second ground element according to the active voltage.

14. The electronic device as claimed in claim 11, wherein the first ground element is electrically connected to the second ground element.

15. The electronic device as claimed in claim 11, wherein the parasitic extending portion is longitudinal, the parasitic conductive portion is L-shaped, an end of the parasitic conductive portion is connected to the parasitic extending portion, and another end of the parasitic conductive portion is connected to the switch unit.

16. The electronic device as claimed in claim 15, wherein the parasitic conductive portion comprises a first section and a second section, and the first section is connected to the second section, and the first section is connected to the parasitic extending portion, wherein the second section extends parallel to the terminal portion, and a first extending direction of the first section is perpendicular to a second extending direction of the second section.

17. The electronic device as claimed in claim 16, wherein the second section extends parallel to the terminal section.

18. The electronic device as claimed in claim 17, wherein the second section is located between the terminal portion and the second ground element.

* * * * *